US008091900B2

(12) United States Patent
Moon

(10) Patent No.: US 8,091,900 B2
(45) Date of Patent: Jan. 10, 2012

(54) APPARATUS FOR OPERATING ROLLER IMBEDDED IN A SHOE UP AND DOWN

(76) Inventor: Duk-Ki Moon, Gimhae-si (KR)

( * ) Notice: Subject to any disclaimer, the term of this patent is extended or adjusted under 35 U.S.C. 154(b) by 489 days.

(21) Appl. No.: 12/266,761

(22) Filed: Nov. 7, 2008

(65) Prior Publication Data

US 2009/0236808 A1 Sep. 24, 2009

(30) Foreign Application Priority Data

Mar. 20, 2008 (KR) ..... 10-2008-0025872

(51) Int. Cl.
*A63C 17/00* (2006.01)
*A63C 17/02* (2006.01)

(52) U.S. Cl. ..... 280/11.19; 280/11.221; 280/11.223; 280/11.225; 280/11.231

(58) Field of Classification Search ..... 280/11.19, 280/843, 11.221, 11.222, 11.223, 11.225, 280/11.226, 11.227, 11.231, 11.232, 11.233, 280/11.25
See application file for complete search history.

(56) References Cited

U.S. PATENT DOCUMENTS

| | | | | |
|---|---|---|---|---|
| 5,785,327 | A * | 7/1998 | Gallant | 280/11.27 |
| 6,394,468 | B1 * | 5/2002 | Chiang et al. | 280/11.223 |
| 6,402,162 | B1 * | 6/2002 | Chiang | 280/11.233 |
| 6,450,508 | B1 * | 9/2002 | Chu | 280/11.208 |
| 6,523,836 | B1 * | 2/2003 | Chang et al. | 280/11.223 |
| 6,572,120 | B2 * | 6/2003 | Chang | 280/11.233 |
| 7,195,251 | B2 * | 3/2007 | Walker | 280/11.19 |
| 7,712,749 | B2 * | 5/2010 | Moon et al. | 280/11.19 |
| 2002/0089132 | A1 * | 7/2002 | Chu | 280/11.223 |
| 2002/0121749 | A1 * | 9/2002 | Lee | 280/11.25 |
| 2002/0145263 | A1 * | 10/2002 | Yang | 280/11.19 |
| 2003/0062697 | A1 * | 4/2003 | Chu | 280/11.221 |
| 2003/0102642 | A1 * | 6/2003 | Wang | 280/11.233 |
| 2004/0140635 | A1 * | 7/2004 | Yoo | 280/11.231 |
| 2004/0155415 | A1 * | 8/2004 | Seleznev et al. | 280/11.227 |

FOREIGN PATENT DOCUMENTS

| | | |
|---|---|---|
| KR | 20-0390407 | 7/2005 |
| KR | 10-0769822 | 10/2007 |

* cited by examiner

*Primary Examiner* — John R Olszewski
(74) *Attorney, Agent, or Firm* — Rabin & Berdo, P.C.

(57) ABSTRACT

An apparatus for operating a roller up and down is provided, which includes a main body fixed to a bottom of a shoe, an operating body to which the roller is imbedded, which is slidably mounted within the main body, and an operating assembly to move the operating body within the main body between an operating position and a non-operating position, wherein the roller protrudes out from the main body in the operating position while the roller is retracted into the main body in the non-operating position. A wearer of a shoe is capable of shifting the shoe between an operating position in which the roller protrudes out from the bottom of the shoe and a non-operating position in which the roller is retracted into the bottom of the shoe, by a simple operation. Accordingly, the shoe can be used as a roller shoe when the roller is in the operating position, and used as a general walking shoe for everyday use when the roller is in the non-operating position. As a result, the wearer can conveniently use a roller shoe as well as a walking shoe with one shoe.

12 Claims, 9 Drawing Sheets

APPARATUS FOR OPERATING ROLLER IMBEDDED IN A SHOE UP AND DOWN

CROSS-REFERENCE TO RELATED APPLICATIONS

This application claims benefit under 35 U.S.C. §119(a) of Korean Patent Application No. 2008-0025872, filed on Mar. 20, 2008 in the Korean Intellectual Property Office, the entire contents of which are incorporated herein by reference.

BACKGROUND OF THE INVENTION

1. Field of the Invention

The present invention relates to an apparatus for operating a roller up and down, and more particularly, to an apparatus for operating a roller imbedded in a shoe worn for everyday use up and down, enabling a wearer not only to walk, but also enjoy roller skating with the shoe.

2. Description of the Related Art

Roller skates or inline skates are the shoes to which roller-bearing assemblies are attached so that the wearers can use them as a form of a recreation as well as a sport.

In order to travel with roller skates or inline skates, people generally pack their skates, go somewhere that it is possible to skate, change their shoes to roller skates or inline skates, and keep their shoes somewhere safe while they are enjoying skating. After skating, it is then necessary to change to normal shoes, and pack and carry the skates to home.

The problem is that the roller skates or inline skates are much larger and heavier than general shoes, and thus it is inconvenient to carry them. It is also inconvenient for a wearer to change from normal shoes to roller skates or inline skates, or vice versa, every time he or she wants to glide.

In order to resolve inconvenience experienced with the conventional skates, a roller shoe, in which roller is imbedded, has been developed.

For example, a roller may be imbedded in the back, or in both back and fore ends of the bottom surface of the shoe.

However, the conventional roller shoe has a roller always protruding from the surface of the shoe, frequently causing the wearer to lose balance while walking and get injured.

SUMMARY OF THE INVENTION

Therefore, the present invention has been made in view of the above-mentioned problems, and it is an aspect of the present invention to provide an apparatus for operating a roller imbedded in a general shoe up and down, enabling a wearer to shift from walking to skating and vice versa with convenience and also preventing the wearer from getting injured.

In order to achieve the above-described aspects of the present invention, there is provided an apparatus for operating a roller up and down, which includes a main body fixed to a bottom of a shoe, an operating body to which the roller is imbedded, which is slidably mounted within the main body, and an operating assembly to move the operating body within the main body between an operating position and a non-operating position, wherein the roller protrudes out from the main body in the operating position while the roller is retracted into the main body in the non-operating position.

The operating assembly may include a guide plate placed on an upper portion of the main body, and a cam bar arranged on a surface of the guide plate which faces the operating body, to move between a retracting position in which the cam bar is arranged parallel to the guide plate, and an upright position in which the cam bar stands upright from the guide plate to press the operating body.

The guide plate may include a cam bar receiving portion to receive the cam bar therein when the cam bar is arranged in the retracting position, and cam bar receiving portion being formed in a corresponding configuration to the cam bar.

The cam bar may include an axle portion, a pressing portion to press the operating body when the cam bar protrudes from the axle portion and is arranged to the upright position, and a supporting segment protruding from the axle portion to form an angle with respect to the pressing portion, to contact the guide plate and maintain the cam bar in the upright position when the cam bar is arranged in the upright position.

The cam bar may include an operating groove formed on an end to receive an operating tool to operate a rotating movement of the cam bar.

The apparatus may further include a cam bar supporting portion having a tubular support through which one end of the cam bar is passed, and the operating groove may be exposed outside through the tubular support.

The cam bar supporting portion may include a ball receiving portion extending from the tubular support, a ball received in the ball receiving portion and partly protruding to an interior of the tubular support, and a spring mounted within the ball receiving portion to press the ball toward the tubular support, and the cam bar may include a position indicating hole formed on an outer circumference of one end, to receive a part of the ball.

The supporting segment may contact the guide plate and the pressing portion is rotated away from the guide plate 90° or more, when the cam bar is in the upright position.

The pressing portion and the guide plate may be at an angle ranging from 95° to 125° when the cam bar is in the upright position.

The operating body may include an inclined surface formed on a surface which faces the guide plate, which is gradually recessed along a direction of rotation of the pressing portion so that an end of the pressing portion is moved in contact with the inclined surface when the cam bar is rotated, and a separation preventive protrusion protruding from an end of the inclined surface to impede the rotation of the pressing portion.

The operating body may include a plurality of shaft holes, and the guide plate may include a plurality of fitting holes to correspond to the shaft holes.

The apparatus may include a plurality of shafts to pass through the shaft holes of the operating body and engaged with the fitting holes of the guide plate, and an elastic body disposed within each of the shaft holes to surround outer circumference of each shaft, wherein the operating body is returned to the non-operating position due to recovery force of the elastic body.

The operating body may include a plurality of guide ribs protruding along a direction of movement of the operating body, the main body may include guide grooves formed in an inner wall to receive the guide ribs of the operating body, and the guide groove may be formed to have a length such that the roller is not exposed outside the bottom of the shoe when the roller is arranged in the non-operating position.

The operating body may include therein a rotating body to rotate with respect to the operating body, and the roller may be mounted to the rotating body.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE EXEMPLARY EMBODIMENTS

Hereinafter, an exemplary embodiment of the present invention will be described in detail with reference to the accompanying drawing figures.

The matters defined in the description such as a detailed construction and elements are nothing but the ones provided to assist in a comprehensive understanding of the invention. Thus, it is apparent that the present invention can be carried out without those defined matters.

Figure 1:
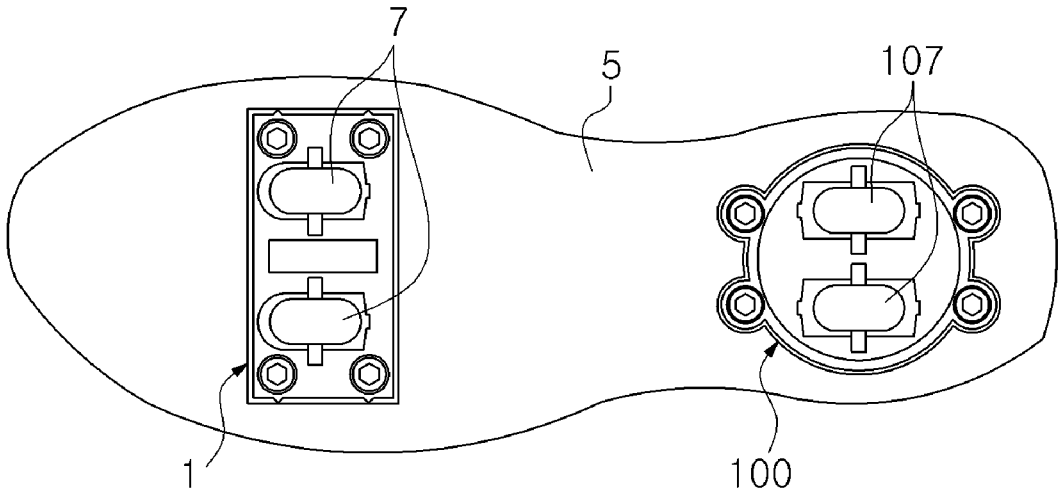
FIG. 1 illustrates a bottom of a shoe to which an apparatus for operating a roller up and down is imbedded according to an exemplary embodiment of the present invention.
Figure 2:
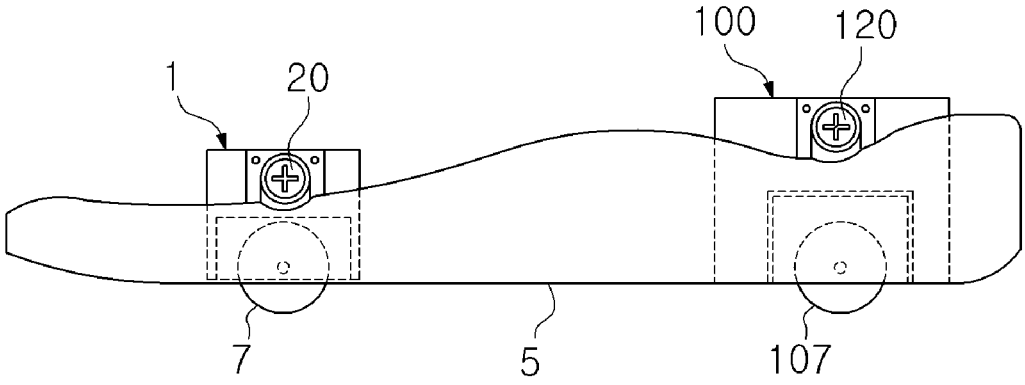
FIG. 2 illustrates a roller of the apparatus of FIG. 1 protruding from the bottom of the shoe.
Figure 3:
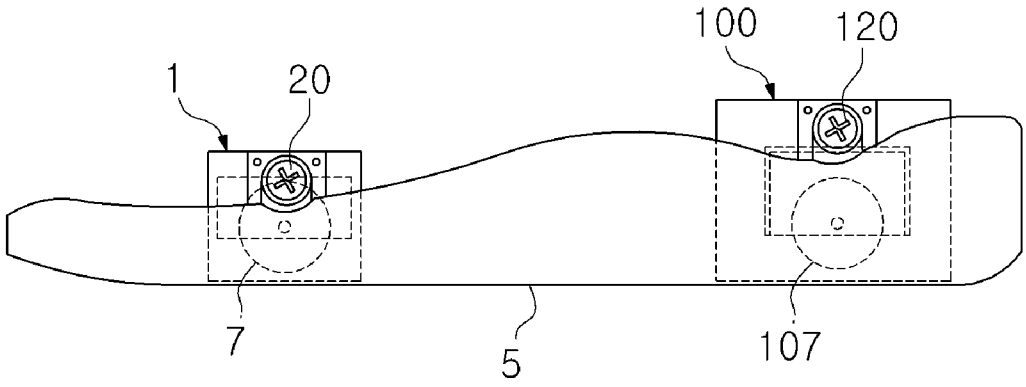
FIG. 3 illustrates the roller of the apparatus of FIG. 1 retracted into the bottom of the shoe.

FIG. 1 illustrates a bottom of a shoe to which an apparatus for operating a roller up and down is imbedded according to an exemplary embodiment of the present invention, FIG. 2 illustrates a roller of the apparatus of FIG. 1 protruding from the bottom of the shoe, and FIG. 3 illustrates the roller of the apparatus of FIG. 1 retracted into the bottom of the shoe.

Referring to FIG. 1, apparatuses for operating a roller up and down 1, 100 according to an exemplary embodiment of the present invention may be imbedded in fore and back ends of a shoe bottom 5 in a penetrating manner. For convenience of explanation, it is assumed that the apparatus 1 in the fore end of the shoe bottom 5 is the apparatus for operating a linear type roller up and down ('linear type roller operating apparatus'), while the apparatus 100 in a back end of the shoe bottom 5 is the apparatus for operating a rotating type roller up and down ('rotating type roller operating apparatus').

The apparatuses 1, 100 may have rollers 7, 107 which alternate between protruding out from the shoe bottom 5 as shown in FIG. 2, and retracting into the shoe bottom 5 as shown in FIG. 3.

The linear type roller operating apparatus 1 will be explained first.

Figure 4:
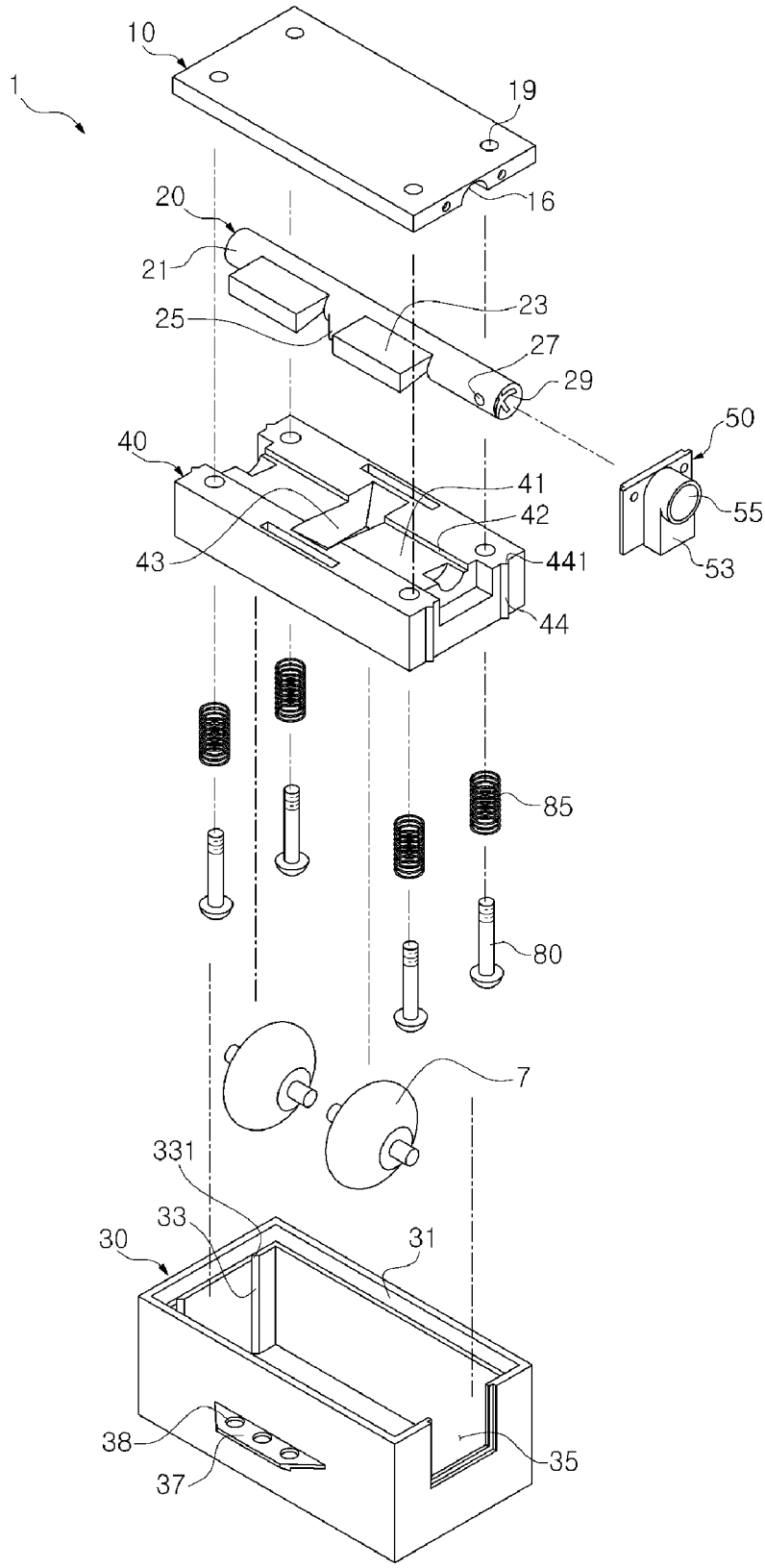
FIG. 4 is an exploded perspective view illustrating from above an apparatus for operating a linear type roller up and down according to an exemplary embodiment of the present invention.
Figure 5:
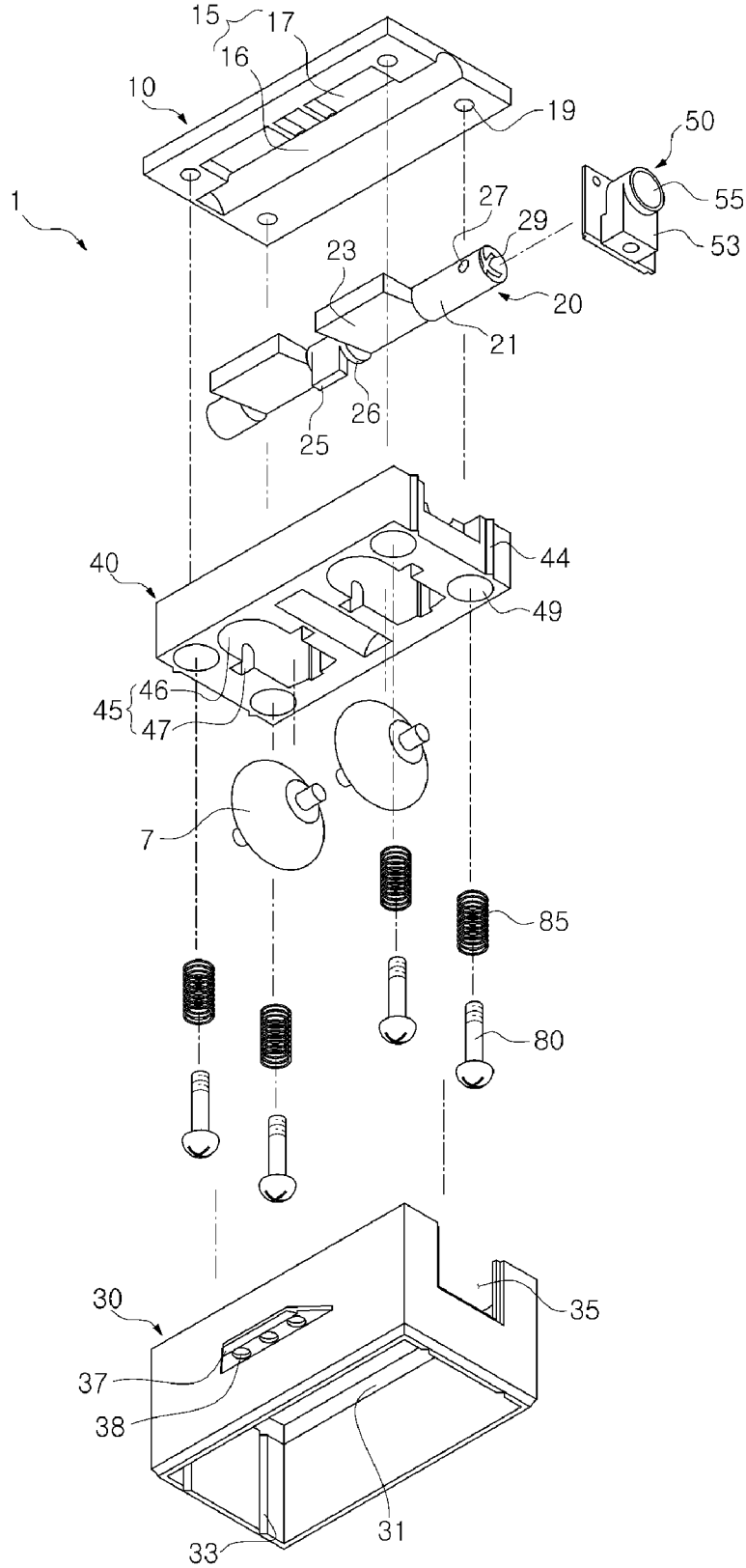
FIG. 5 is an exploded perspective view illustrating from below the apparatus of FIG. 4.

FIGS. 4 and 5 are exploded perspective views of the linear type roller operating apparatus 1 according to an exemplary embodiment of the present invention.

The linear type roller operating apparatus 1 may include an operating body 40, a main body 30, and operating assemblies 10, 20.

The roller 7 is mounted to the operating body 40 to be protruded out from the shoe bottom 5 or retracted into the shoe bottom 5.

The operating assemblies 10, 20 operate the operating body 40 between an operating position in which the roller 7 is protruded from a main body 30, and a non-operating position in which the roller 7 is retracted into the main body 30.

The main body 30 may be configured as a rectangular box, of which two opposite sides are open, and fixed to the shoe bottom 5 in a manner such that both open sides are arranged in thickness direction of the shoe bottom 5. A recess 31 is formed to a predetermined depth, at the upper open area of an inner wall of the main body, and along the edge of the inner wall. The recess 31 receives a guide plate 10 which will be explained below. The recess 31 is formed in the upper open area to correspond to the thickness of the guide plate 10 so as to allow the guide plate 10 to be received in the main body 30 without protruding out.

A guide groove 33 is extended from a lower open area of the main body 30 to the recess 31, along the inner wall of the main body 30. Accordingly, as a guide rib 44 of the operating body 40, which will be explained below, is slid along the guide groove 33, the operating body 40 is moved within the main body 30. There may be a plurality of guide grooves 33 formed in a pair of shorter inner sidewalls having shorter widths than the other inner sidewalls of the main body 30. However, the number or location of the guide grooves 33 is not limited, and therefore, these can be adjusted as necessary. The guide grooves 33 may be formed deeper than the recess 31. By doing so, an end 441 of the guide rib 44 is impeded by the recess 31 near the end 331 of the guide groove 33, causing the operating body 40 to stop in its movement toward the upper open area of the main body 30.

Each guide groove 33 is formed to have a length such that the roller 7 is retracted into the shoe bottom 5, without being protruded out from the shoe bottom 5 while the wearer is walking. Each guide groove 33 may be configured to have a triangular cross section, and thus have narrow contact area as possible, thereby minimizing possible friction during sliding movement of the operating body 40 which will be explained in greater detail below.

Meanwhile, a pair of fixing ribs 37 may protrude from an outer wall of the main body 30. Each of the fixing ribs 37 may include a plurality of holes 38 formed therein. The fixing ribs 37 are arranged between a midsole and an outsole of the shoe bottom 5 to prevent the linear type roller operating apparatus 1 from separating from the shoe bottom 5.

On one shorter sidewall of the main body 30 is formed a cutaway portion 35, provided for the exposure of a cam bar 20 which will be explained in detail below.

Meanwhile, the operating assemblies 10, 20 may each include the guide plate 10 and the cam bar 20.

The guide plate 10 may be configured to be a square plate which closes the upper open area of the main body 30, and inserted in the recess 31 of the main body 30 and fixed therein. The thickness of the guide plate 10 may almost correspond to the depth of the recess 31.

On a surface of the guide plate 10 that faces the inner side of the main body 30, there is a cam bar receiving portion 15 recessed in a configuration corresponding to the cam bar 20 to receive the cam bar 20 therein. The cam bar receiving portion 15 may include an axle receiving area 16 longitudinally recessed along the middle portion of the guide plate 10 into a semi-cylindrical configuration, and a plate receiving area 17 also longitudinally extending on a side of the axle receiving area 16 in a rectangular configuration. One end of the axle receiving area 16 is open, to allow one end of the cam bar 20 to pass and be exposed to outside.

A plurality of fastening holes 19 are penetratingly formed in each of the corners of the guide plate 10, through which shafts 80 are passed to fasten with the operating body 40. On one end of each shaft 80 is formed a female screw.

The cam bar 20 is received in the cam bar receiving portion 15 of the guide plate 10, and may be made from metal material such as aluminum or alloy.

The cam bar 20 may include an axle portion 21 operating as an axle for the cam bar 20 to rotate between retracting position and upright position, a pressing portion 23 protruding from the axle portion 21 to press the operating body 40 when the cam bar 20 is placed in the upright position, and a supporting segment 25 protruding from a side of the axle portion 21 to form a predetermined angle with the pressing portion 23, and contact the guide plate 10 to keep the cam bar 20 in the upright position once the cam bar 20 is moved to the upright position.

The axle portion 21 of the cam bar 20 may have one and the other ends formed in cylindrical shapes, and an area having the pressing portion 23 which is formed in a straightened bar configuration to have a thickness corresponding to that of the pressing portion 23. One end of the axle portion 21 protrudes out from the shoe bottom 5, and on the terminating end of the exposed end of the axle portion 21, there is an operating groove 29 formed to receive a tool to operate the rotation of the cam bar 20. The operating groove 29 may be in a form of a line, or two lines crossing each other, and allows a wearer to rotate the cam bar 20 by inserting any adequate tool at hand, such as a driver, pin, or key, or a dedicated tool (not illustrated) provided by a shoe maker, and rotating the tool in a predetermined direction.

The axle portion 21 may include the position indicating hole 27 which is recessed to a hemispherical shape in an outer circumference of the axle portion 21, near the operating hole 29. When the cam bar 20 is arranged in the upright position, the ball 54 is received in the position indicating hole 27, generating impulsive sound. Therefore, the wearer knows from the sound that the cam bar 20 is in the upright position.

The pressing portion 23 rotates between the upright position and retracting position in accordance with the rotating movement of the axle portion 21 of the cam bar 20.

Figure 9:
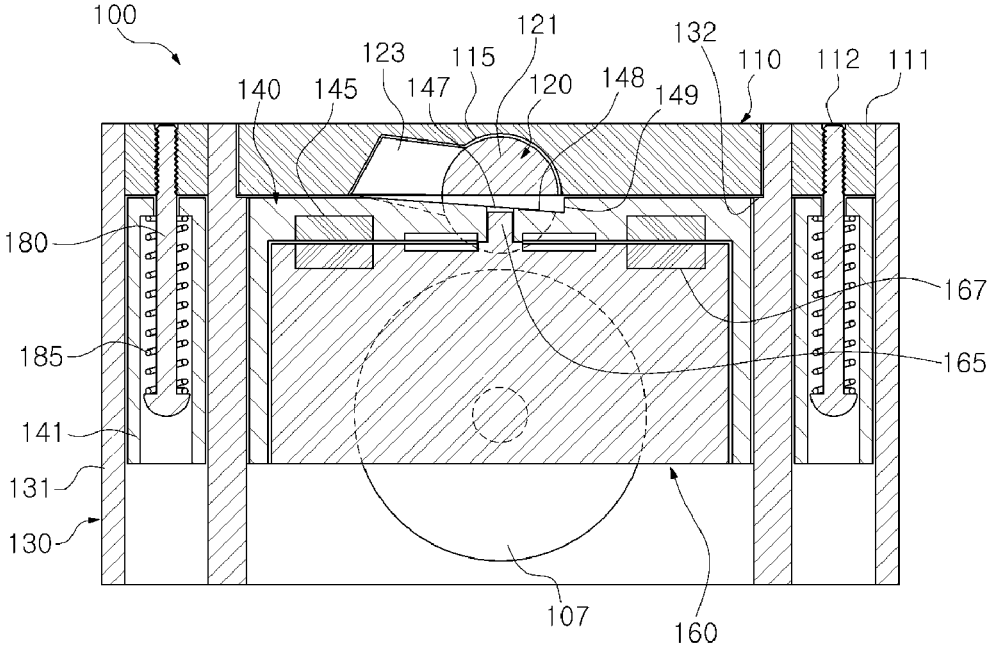
FIG. 9 is a cross-section view illustrating an apparatus for operating a linear type roller up and down placed in operating position.

The supporting segment 25 rotates 90° or more to cause the cam bar 20 to rotate to the upright position and press the operating body 40. The location of the supporting segment 25 is determined so that the supporting segment 25 maintains less than 90° with respect to the pressing portion 23 (FIG. 9). In other words, the supporting segment 25 is positioned so that the pressing portion 23 and the guide plate 10 are at an angle ranging from 95° to 125°, and preferably at 115°, when the cam bar 20 is in upright position. Since the pressing portion 23 is rotated 90° or more and thus presses the operating body 40 at an inclined state, it is impossible to return the pressing portion 23 to the initial position without operating the operating groove 29. Accordingly, the roller 7 can not be retracted into the main body 30 due to external impacts to cause the wearer undesirable injuries while the wearer is skating with the shoe.

Figure 14:
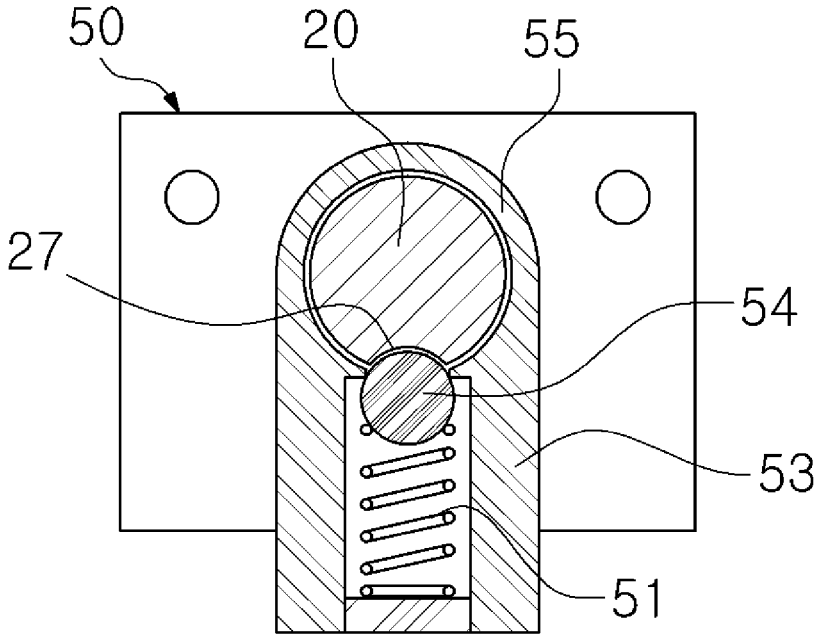
FIG. 14 illustrates a ball received in a position indicating hole when a cam bar is in upright position.
Figure 15:
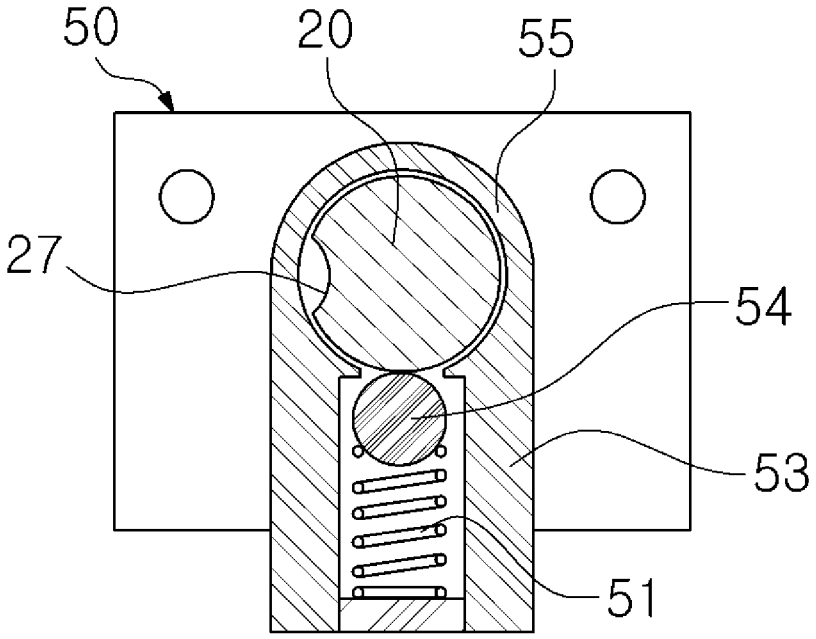
FIG. 15 illustrates relative position between a ball and a position indicating hole when a cam bar is in retracted position.

Referring to FIGS. 4, 14, and 15, on a side of the main body 30 is formed a cam bar supporting segment 50 to support one end of the axle portion 21 of the cam bar 20. The cam bar supporting portion 50 may be formed in a configuration corresponding to that of the cutaway portion 35 of the main body 30, that is, in the configuration of a square plate.

The cam bar supporting segment 50 may include a tubular support 55 through which the axle portion 21 of the cam bar 20 is passed.

On one side of the tubular support 55 is formed a ball receiving portion 53 extending from the interior of the tubular support 55. The ball receiving portion 53 receives therein the ball 54 protruding partly toward the interior of the tubular support 55, and a spring 51 to bias the ball 54 toward the tubular support 55. As one end of the axle portion 21 of the cam bar 20 is received in the tubular support 55, the ball 54 is brought into contact with the outer circumference of the axle portion 21. If the cam bar 20 is moved to the upright position in accordance with the rotation of the cam bar 20, referring to FIG. 14, the ball 54 is received in the position indicating hole 27 of the axle portion 21, generating impulsive sound between the ball 54 and the position indicating hole 27. Therefore, the wearer easily knows that the cam bar 20 is now in upright position.

The supporting plate 55 is exposed to a side area of the shoe bottom 5, and the operating groove 29 of the axle portion 21 received in the tubular support 55 is exposed to the wearer through the tubular support 55. Accordingly, the wearer is able to shift the roller 7 from non-operating position to operating position or vice versa, conveniently, by using the operating groove 29 exposed to outside.

The operating body 40 may be formed in hexahedron configuration and slidably received in the main body 30. Along the outer circumference of the operating body 40 is formed a plurality of guide ribs 44 protruding longitudinally in the sliding direction of the operating body 40. The guide ribs 44 have triangular cross-section and may be formed plurally on the shorter sidewalls of the operating body 40. If the operating body 40 is received in the main body 30, the guide ribs 44 are received in the guide grooves 33 of the main body 30, allowing the operating body 40 to move smoothly within the main body 30.

On a surface of the operating body 40 that faces the guide plate 10, an inclined surface 41 is formed in a rotating direction of the pressing portion 23 to contact the end of the pressing portion 23 during the rotation of the cam bar 20, while on the end of the inclined surface 41 in the rotating direction, there is a separation preventive protrusion 42 formed to impede rotating movement of the pressing portion 23. Additionally, on a middle area of the operating body 40 where the inclined surface 41 is formed, there is a supporting segment receiving portion 43 recessed to receive the supporting segment 25 when the cam bar 20 is in retracting position.

On a surface of the operating body 40 that faces the ground, there is formed a roller receiving cavity 45 to receive the roller 7 therein. Although there is a pair of roller receiving cavities 45 in the exemplary embodiment explained herein, one will understand that the number of roller receiving cavities 45 may change according to the size, use or design of the shoe. Each of the roller receiving cavities 45 may include a roller receiving area 46 formed in a semi-cylindrical configuration, and an axle receiving area 47 to receive an axle of the roller 7.

Meanwhile, the operating body 40 includes a plurality of shaft holes 49 formed in each corner, through which shafts 80 are passed to elastically engage with the guide plate 10. Each of the shaft holes 49 may be formed as a hollow cylinder, in which one end that faces the guide plate 10 has a decreasing diameter to prevent the head of the shaft 80 from falling out. A spring 85 as an elastic member is disposed in each of the shaft holes 49. Accordingly, the shaft 80, with its head down, is passed through the spring 85 and the shaft hole 49 in sequence, and fixed in the fastening hole 19 of the guide plate 10. The spring 85 may be a compression spring. In the retracting position where the cam bar 20 does not press the operating body 40, the operating body 40 is brought into tight contact with the guide plate 10 due to elastic recovery force of the spring 85, while in the upright position where the cam bar 20 presses the operating body 40, the operating body 40 is distanced away from the guide plate 10, causing the spring 85 further expanded. The operation of the linear type roller operating apparatus 1 will be explained below based on the construction explained above and with reference to FIGS. 8 and 9.

In the non-operating position where the roller 7 is not protruded out from the shoe bottom 5 (shown in FIG. 8), the cam bar 20 is in the cam bar receiving portion 15 which is the retracting position. If a wearer wants to skate, he or she inserts a separate tool in the operating groove 29. The wearer then rotates the cam bar 20 by 90° or more, or for example, by 115°. Accordingly, the cam bar 20 moves to the upright position, and the pressing portion 23 presses the operating body 40 and causes the spring 85 to compress. Referring to FIG. 9, if the cam bar reaches the upright position, the supporting segment 25 is brought into contact with the guide plate 10, and the pressing portion 23 presses the operating body 40. At the same time, the ball is received in the position indicating hole 27, generating impulsive sound. Accordingly, the wearer knows from the impulsive sound that the roller 7 protrudes out from the main body 30 to the maximum and thus is set at the operating position.

Figure 8:
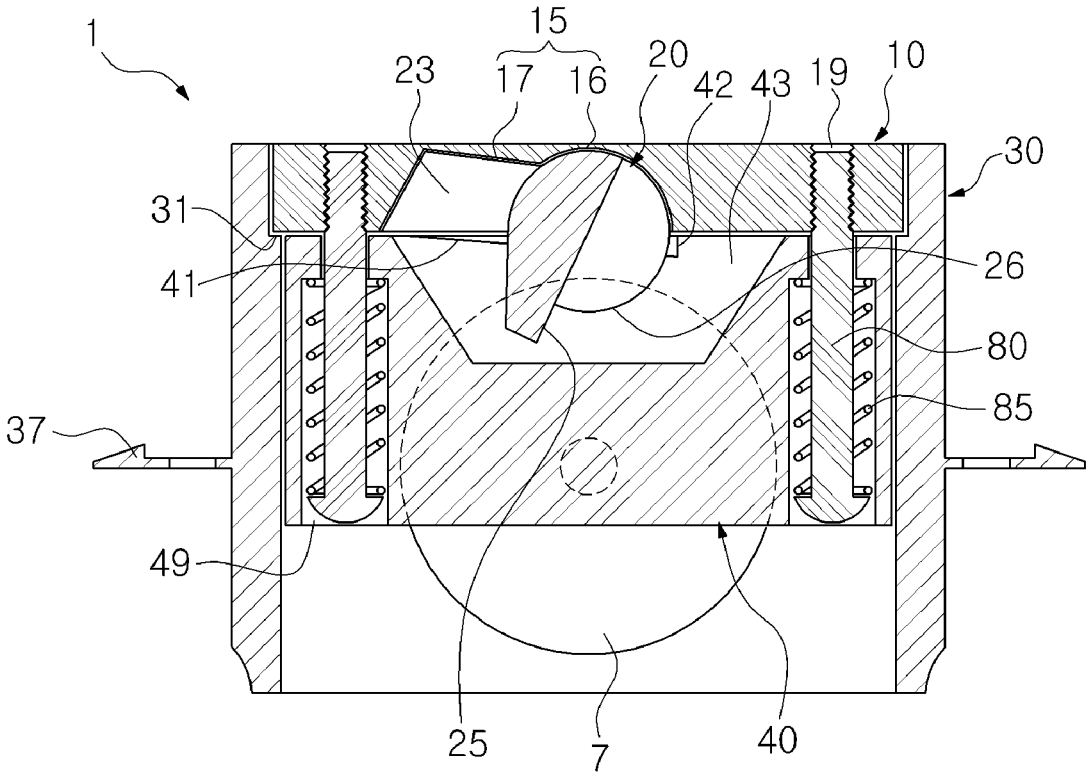
FIG. 8 is a cross-section view illustrating an apparatus for operating a linear type roller up and down placed in non-operating position.

If the wearer wants to walk and thus wants to return the roller 7 back to non-operating position, referring to FIG. 8, the wearer inserts the tool in the operating groove 29 and rotates the cam bar 20 in the opposite direction. Accordingly, the cam bar 20 is received in the cam bar receiving portion 15, thereby releasing the operating body 40 from the pressing portion 23. Additionally, the operating body 40 is brought into tight contact with the guide plate 10 due to the elastic recovery force of the spring 85, and the roller 7 is retracted into the main body 30 completely.

Figure 6:
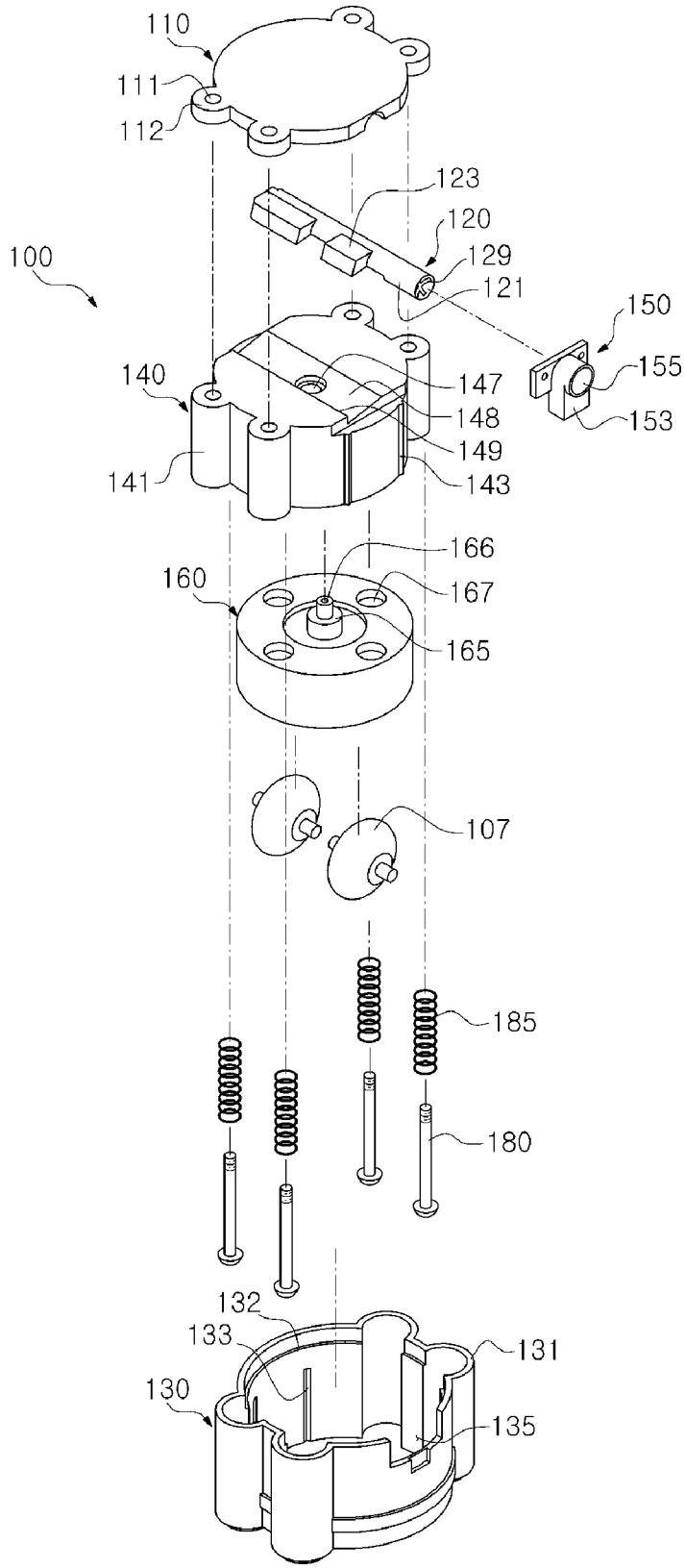
FIG. 6 is an exploded perspective view illustrating from above an apparatus for operating a rotating type roller up and down according to an exemplary embodiment of the present invention.
Figure 7:
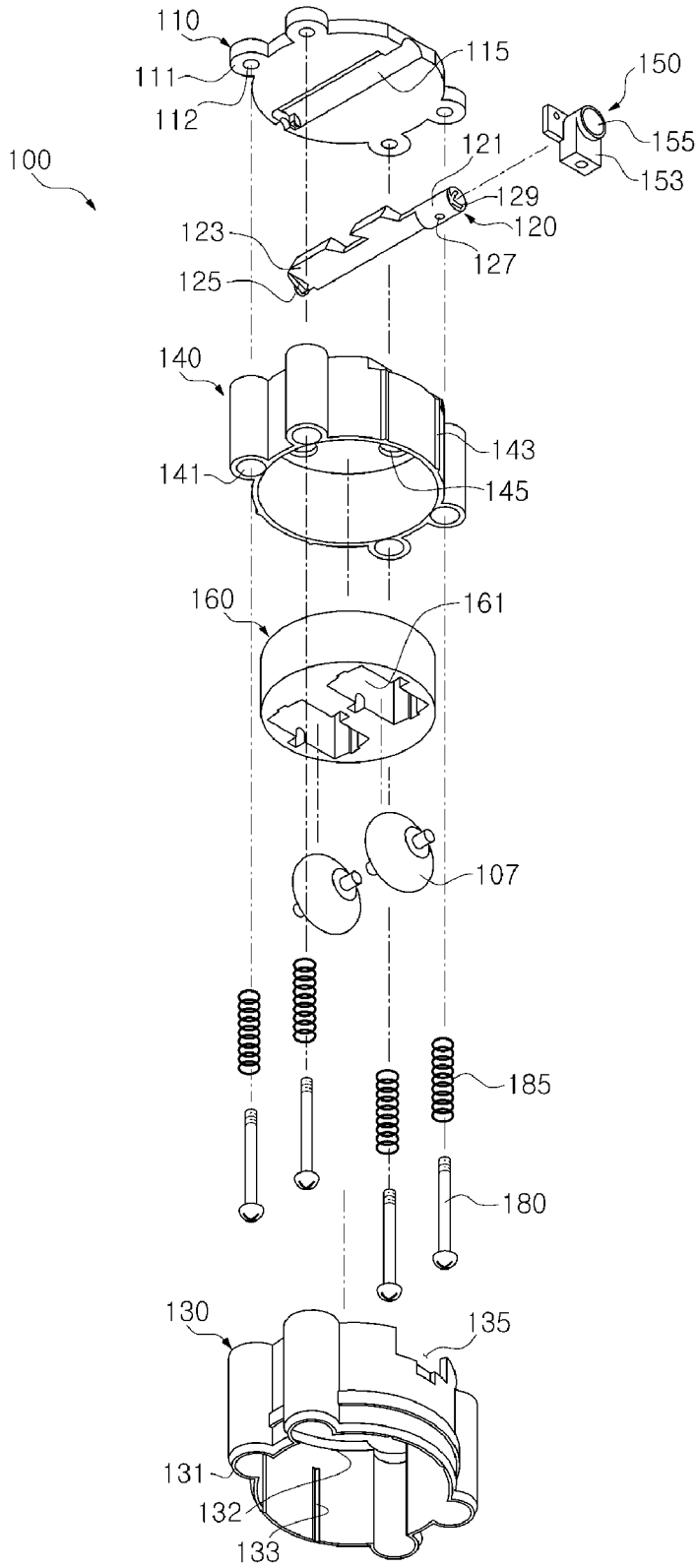
FIG. 7 is an exploded perspective view illustrating from below the apparatus of FIG. 6.

FIG. 6 is an exploded perspective view illustrating from above a rotating type roller operating apparatus 100 according to an exemplary embodiment of the present invention, and FIG. 7 is an exploded perspective view illustrating from below the apparatus of FIG. 6.

The rotating type roller operating apparatus 100 basically has the same operating principle and structure as those of the liner type roller operating apparatus 1 explained above, except that the rotating type roller operating apparatus 100 has a different structure in that the roller 107 is designed to rotate with respect to the shoe bottom 5. Therefore, only the difference of the rotating type roller operating apparatus 100 will be focused below. Meanwhile, since the structure that enables the roller 107 to rotate with respect to the shoe bottom 5 is not the core part of the present invention, detailed explanation thereof will be omitted here, and instead referred to Korean Patent Registration No. 0769822, granted on Oct. 17, 2007, to the present applicant.

The rotating type roller operating apparatus 100 may include an operating body 140, a main body 130, and operating assemblies 110, 120.

The main body 130 may be formed in a cylindrical configuration, and include a plurality of fastening grooves 131 protruding to half-cylinder configurations from the outer surface of the main body 130. As in the linear type roller operating apparatus 1, the main body 130 of the rotating type roller operating apparatus 100 may include a recess 132 to receive a guide plate 110, a guide groove 133 to guide the movement of the operating body 140, and a cutaway portion 135 through which a cam bar 120 is passed.

The operating assemblies 110, 120 may each include the guide plate 110 and the cam bar 120.

The guide plate 110 may be formed in a circular plate, and include a plurality of half-circular plate areas 111 formed therearound. On one surface of the guide plate 110 is formed, by recessing, a cam bar receiving hole 115 to receive the cam bar 210 therein. The half-circular plate areas 111 may each include a fastening hole 112 to engage with the operating body 140.

The cam bar 120 is formed to a straightened bar shape, excluding one and the other ends, so that a pressing portion 123 and an axle portion 121 have the same thickness. On one end of the cam bar 120 is protruded a supporting segment 120 in a triangular configuration, while on the other end of the cam bar 120, there is an operating groove 129 formed. A tubular support 155 to receive the axle 121 to the side where the operating groove 129 is formed, and a cam bar supporting portion 150 having a ball receiving portion 153, are also provided.

The operating body 140 may be formed as a hollow cylinder of which one end that faces the guide plate 110 is closed. Along the outer wall of the operating body 140, a plurality of shaft tubes 141 are arranged in a lengthwise direction of the operating body 140 at predetermined intervals. Each of the shaft tubes 141 may include a shaft 180 and a spring 185 to fasten with the operating body 140 and the guide plate 110. On a closed end of the operating body 140, an inclined surface 148 and a separation preventive protrusion 149 are formed on a surface that faces the guide plate 110. On a middle area of a surface of the operating body 140 that faces the guide plate 110, there is a screw hole 147 passing through the operating body 140.

A plurality of guide ribs 143, corresponding to the guide grooves 133 of the main body 133, are formed on the outer circumference of the operating body 140, in the height direction of the operating body 140. Meanwhile, on the closed end of the operating body 140 is formed a plurality of magnet holes 145 in a circumferential direction, on a surface that faces the interior of the operating body 140. N-pole magnets and S-pole magnets are mounted to the magnet holes 145 alternately.

The operating body 140 receives therein a rotating body 160 to rotate with respect to the operating body 140. The rotating body 160 may be formed as a cylinder column, and include a pole 165 formed on a middle portion of a surface that faces the interior of the operating body 140 and protruding toward the screw hole 147 of the operating body 147. The pole 165 includes a fitting hole 166 formed therein. The screw hole 147 of the operating body 147 has a larger diameter than that of the fitting hole 166 of the rotating body 160, so that when a screw is passed through the screw hole 147 of the operating body 140 and the fitting hole 166 of the rotating body 160, the rotating body 160 and the operating body 140 are engaged with each other in a manner in which the rotating body 160 rotates about the screw with respect to the operating body 140.

A plurality of magnet receiving holes 167 is formed along a circumferential direction on a surface of the rotating body 160 that faces the operating body 140, in the same number as that of the magnet holes 145 formed on the operating body 140. The magnet receiving holes 167 also receive N-pole magnets and S-pole magnets alternately. The magnets are arranged so that the magnets in the magnet receiving holes 167 have opposite polarity to the magnets received in the magnet holes 145 in a situation that the rotating body 160 is not rotated. Accordingly, if N-pole magnets are arranged in the magnet receiving holes 167 when the rotating body 160 is not rotated, the S-pole magnets are then arranged in the magnet holes 145 to generate attraction force.

The rotating body 160 is capable of rotating 360° in the rotating direction of the wearer, if the wearer rotates his or her body using the roller 107 of the rotating type roller operating apparatus 100. Furthermore, due to the magnets pulling on different polarities, the rotating body 160 is rotated back after rotating movement, in the same direction that the wearer advances.

The rotating structure between the rotating body 160 and the operating body 140 is explained in greater detail in Korean Patent Registration No. 0769822, granted on Oct. 17, 2007, to the present applicant.

Meanwhile, a plurality of roller receiving cavities 161 is formed on a surface of the rotating body 160 that faces the outside of the operating body 140, to receive the roller 107 therein.

Figure 10:
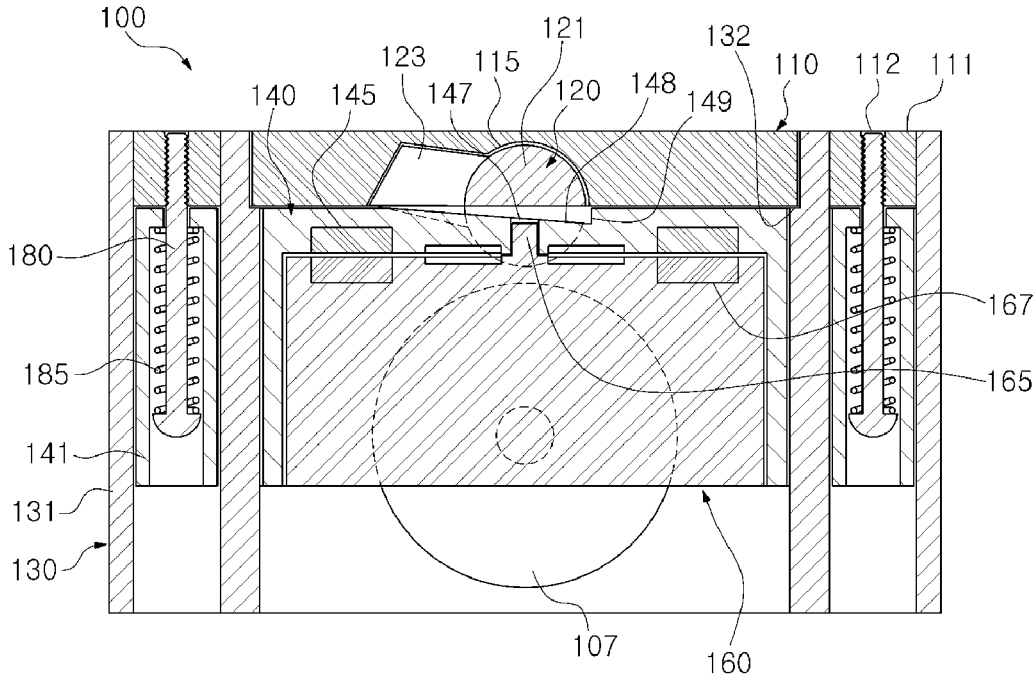
FIG. 10 is a cross-section view illustrating an apparatus for operating a rotating type roller up and down placed in non-operating position.
Figure 12:
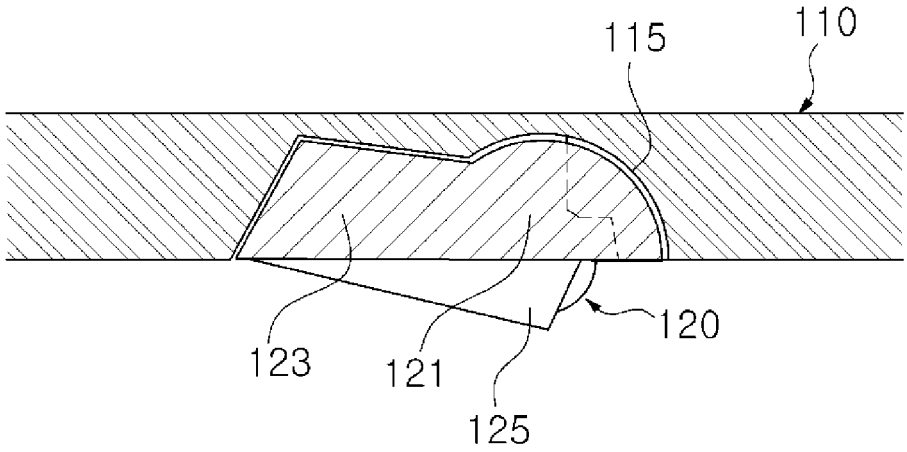
FIG. 12 illustrates a partial enlargement of FIG. 10.

Referring to FIGS. 10 and 12, in the rotating type roller operating apparatus 100, the cam bar 120 is received in the cam bar receiving portion 115 of the guide plate 110 while the roller 107 is in non-operating position.

Figure 11:
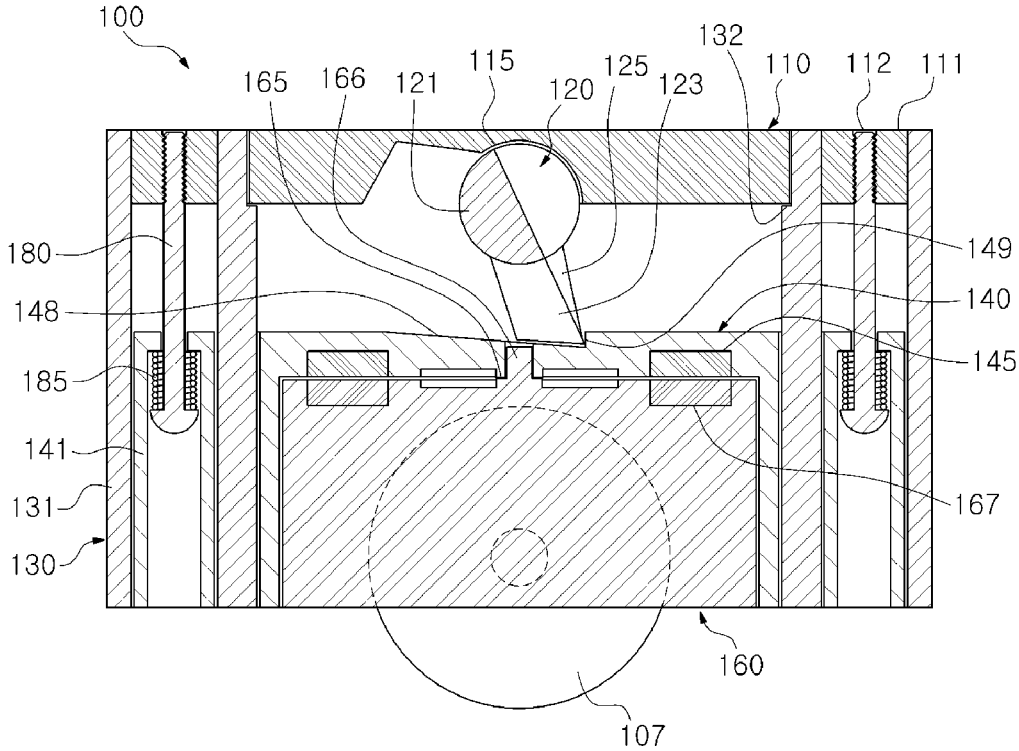
FIG. 11 is a cross-section view illustrating an apparatus for operating a rotating type roller up and down placed in operating position.
Figure 13:
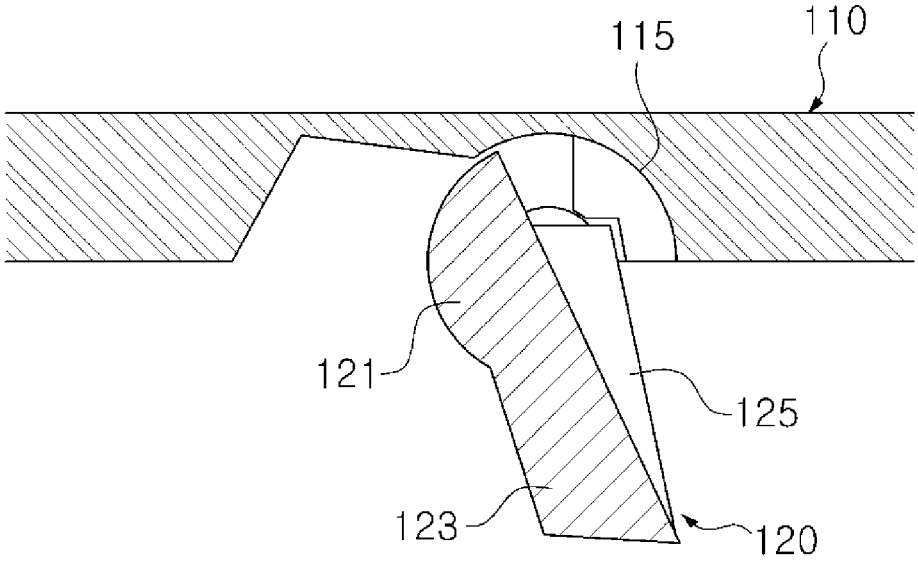
FIG. 13 illustrates a partial enlargement of FIG. 11.

Referring to FIGS. 11 and 13, while the roller 107 is in operating position, the pressing portion 123 of the cam bar 120 presses the operating body 140 so that the operating body 140 is moved toward the lower opening of the main body 130. As a result, the roller 107 of the rotating body 160 protrudes out from the shoe bottom 5.

With the apparatus for operating roller up and down according to the exemplary embodiments of the present invention, a wearer of a shoe is capable of shifting the shoe between an operating position in which the roller protrudes out from the bottom of the shoe and a non-operating position in which the roller is retracted into the bottom of the shoe, by a simple operation. Accordingly, the shoe can be used as a roller shoe when the roller is in the operating position, and used as a general walking shoe for everyday use when the roller is in the non-operating position. As a result, the wearer can conveniently use a roller shoe as well as a walking shoe with one shoe.

While the invention has been shown and described with reference to certain embodiments thereof, it will be understood by those skilled in the art that various changes in form and details may be made therein without departing from the spirit and scope of the invention as defined by the appended claims.

What is claimed is:

1. An apparatus for operating a roller imbedded in a shoe up and down, comprising:

a main body fixed to a bottom of the shoe;

an operating body to which the roller is imbedded, which is slidably mounted within the main body; and an operating assembly to move the operating body within the main body between an operating position and a non-operating position, wherein the roller protrudes out from the main body in the operating position while the roller is retracted into the main body in the non-operating position, wherein the operating assembly comprises:

a guide plate placed on an upper portion of the main body; and a cam bar arranged on a surface of the guide plate which faces the operating body, to move between a retracting position in which the cam bar is arranged parallel to the guide plate, and an upright position in which the cam bar stands upright from the guide plate to press the operating body.

2. The apparatus of claim 1, wherein the guide plate comprises a cam bar receiving portion to receive the cam bar therein when the cam bar is arranged in the retracting position, and cam bar receiving portion being formed in a corresponding configuration to the cam bar.

3. The apparatus of claim 2, wherein the operating body comprises a plurality of guide ribs protruding along a direction of movement of the operating body, the main body comprises guide grooves formed in an inner wall to receive the guide ribs of the operating body, and the guide groove is formed to have a length such that the roller is not exposed outside the bottom of the shoe when the roller is arranged in the non-operating position.

4. The apparatus of claim 1, wherein the cam bar comprises:

an axle portion;

a pressing portion to press the operating body when the cam bar protrudes from the axle portion and is arranged to the upright position; and a supporting segment protruding from the axle portion to form an angle with respect to the pressing portion, to contact the guide plate and maintain the cam bar in the upright position when the cam bar is arranged in the upright position.

5. The apparatus of claim 4, wherein the cam bar comprises an operating groove formed on an end to receive an operating tool to operate a rotating movement of the cam bar.

6. The apparatus of claim 5, further comprising a cam bar supporting portion having a tubular support through which one end of the cam bar is passed, and wherein the operating groove is exposed to outside through the tubular support.

7. The apparatus of claim 6, wherein the cam bar supporting portion comprises a ball receiving portion extending from the tubular support, a ball received in the ball receiving portion and partly protruding to an interior of the tubular support, and a spring mounted within the ball receiving portion to press the ball toward the tubular support, and the cam bar comprises a position indicating hole formed on an outer circumference of one end, to receive a part of the ball.

8. The apparatus of claim 4, wherein the supporting segment contacts the guide plate and the pressing portion is rotated away from the guide plate 90° or more, when the cam bar is in the upright position.

9. The apparatus of claim 8, wherein the pressing portion and the guide plate are at an angle ranging from 95° to 125° when the cam bar is in the upright position.

10. The apparatus of claim 4, wherein the operating body comprises an inclined surface formed on a surface which faces the guide plate, which is gradually recessed along a direction of rotation of the pressing portion so that an end of the pressing portion is moved in contact with the inclined surface when the cam bar is rotated, and a separation preventive protrusion protruding from an end of the inclined surface to impede the rotation of the pressing portion.

11. The apparatus of claim 1, wherein the operating body comprises a plurality of shaft holes, and the guide plate comprises a plurality of fitting holes to correspond to the shaft holes.

12. The apparatus of claim 11, comprising a plurality of shafts to pass through the shaft holes of the operating body and engaged with the fitting holes of the guide plate, and an elastic body disposed within each of the shaft holes to surround outer circumference of each shaft, wherein the operating body is returned to the non-operating position due to recovery force of the elastic body.

* * * * *